US009431202B2

(12) United States Patent
Thomas et al.

(10) Patent No.: US 9,431,202 B2
(45) Date of Patent: Aug. 30, 2016

(54) MAGNETIC TRIP DEVICE OF A THERMAL MAGNETIC CIRCUIT BREAKER HAVING AN ADJUSTMENT ELEMENT

(71) Applicant: Siemens Aktiengesellschaft, Munich (DE)

(72) Inventors: Stephen Scott Thomas, Atlanta, GA (US); Jorg Sizemore, Duluth, GA (US); Esteban Sandoval Camacho, Monterrey (MX)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/558,915

(22) Filed: Dec. 3, 2014

(65) Prior Publication Data

US 2015/0243465 A1 Aug. 27, 2015

(30) Foreign Application Priority Data

Feb. 25, 2014 (EP) ..... 14156608

(51) Int. Cl.

| | |
|---|---|
| ***H01H 75/12*** | (2006.01) |
| ***H01H 71/74*** | (2006.01) |
| ***H01H 71/16*** | (2006.01) |
| *H01H 71/40* | (2006.01) |

(52) U.S. Cl.

CPC ..... *H01H 71/7463* (2013.01); *H01H 71/16* (2013.01); *H01H 71/40* (2013.01)

(58) Field of Classification Search

CPC . H01H 71/405; H01H 71/7463; H01H 71/40
See application file for complete search history.

(56) References Cited

U.S. PATENT DOCUMENTS

| | | | | |
|---|---|---|---|---|
| 2,937,252 | A | 5/1960 | Flick | |
| 3,319,195 | A | 5/1967 | Brumfield | |
| 6,788,174 | B1 | 9/2004 | Carothers | |
| 2015/0035627 | A1* | 2/2015 | Sandoval Camacho et al. | 335/1 |
| 2015/0206688 | A1* | 7/2015 | Cantu Gonzalez | 335/35 |
| 2015/0228433 | A1* | 8/2015 | Carrillo Soto et al. | 335/43 |
| 2015/0243466 | A1* | 8/2015 | Sandoval Camacho et al. | 335/35 |

FOREIGN PATENT DOCUMENTS

| | | |
|---|---|---|
| WO | WO 2013128061 A1 | 8/2013 |
| WO | WO 2013133787 A1 | 9/2013 |

OTHER PUBLICATIONS

Extended European Search Report dated Sep. 1, 2014.

* cited by examiner

*Primary Examiner* — Bernard Rojas
(74) *Attorney, Agent, or Firm* — Harness, Dickey & Pierce, P.L.C.

(57) ABSTRACT

A magnetic trip device of a thermal magnetic circuit breaker and a thermal magnetic circuit breaker including such a magnetic trip device, and also a method for adjusting a magnetic field area of a magnetic trip device of a thermal magnetic circuit breaker, are disclosed. In at least one embodiment, the magnetic trip device includes at least an armature locator moveable arranged at a pin in order to adjust a magnetic field area, and an armature element fixed on a lower surface of the armature locator in order to interact with a yoke, arranged near a current conductive element for conducting electric energy. The armature locator includes an adjustment element arranged between a spring element and the yoke. The spring element surrounding at least a part of the pin is arranged between the armature element and the yoke.

9 Claims, 5 Drawing Sheets

MAGNETIC TRIP DEVICE OF A THERMAL MAGNETIC CIRCUIT BREAKER HAVING AN ADJUSTMENT ELEMENT

PRIORITY STATEMENT

The present application hereby claims priority under 35 U.S.C. §119 to European patent application number EP 14156608.3 filed Feb. 25, 2014, the entire contents of which are hereby incorporated herein by reference.

FIELD

At least one embodiment of the present invention is directed to a magnetic trip device of a thermal magnetic circuit breaker, wherein the magnetic trip device has at least an armature locator moveable arranged at a pin in order to adjust a magnetic field area, and an armature element, fixed on a lower surface of said armature locator in order to interact with a yoke, which is arranged near a current conductive element for conducting electric energy. Furthermore, at least one embodiment of the present invention is directed to a thermal magnetic circuit breaker having a magnetic trip device like mentioned above and at least one embodiment is directed to a method for adjusting a magnetic field area of this magnetic trip device.

BACKGROUND

Essentially it is known that a thermal magnetic circuit breaker is a manually or automatically operated electrical switch designed to protect an electrical circuit from damage caused by overload or short circuit. Its basic function is to detect a fault condition and interrupt current flow. Therefore, the thermal magnetic circuit breaker has for example at least one magnetic trip device in order to prevent the electrical circuit or an electrical device from damage by short circuit and a thermal trip device in order to prevent the electric circuit or an electrical device from damage by overload. A short circuit is an abnormal connection between two nodes of the electric circuit intended to be at different voltages. And especially in reference to a molded-case circuit breaker, a short-circuit is an abnormal connection between two separate phases, which are intended to be isolated or insulated from each other. This results in an excessive electric current, named an overcurrent limited only by the Thévenin equivalent resistance of the rest of the network and potentially causes circuit damage, overheating, fire or explosion. An overload is a less extreme condition but a longer-term over-current condition as a short circuit.

The magnetic trip device has at least an armature element moveable arranged with respect to a yoke or especially to a current conduction element conducting electrical energy or current, respectively. The armature element or armature, respectively, is a magnetic element and especially a pole piece having at least partially an iron material and reacting to a magnetic field created by the yoke during a trip moment. In order to realize a guided movement of the armature element towards the yoke at least during a trip event like a short circuit, the armature element is arranged at an armature locator. The armature locator is moveable arranged at a pin extending from an adjustment bar towards the yoke. The armature locator or the adjustment bar is connectable with a trip bar, which is able to interrupt a current flow of the current circuit, when the trip bar is moved. For example, the trip bar is moved due to a movement of the armature locator or the adjustment bar in conjunction with the armature element towards the yoke because of a magnetic force.

Thermal magnetic circuit breakers are classified for example by different rated currents or tripping characteristics and/or according to the resistance to unwanted tripping due to transient voltages and the time delay in the presence of a residual current. In order to calibrate a translational magnetic system of a thermal magnetic circuit breaker it is known to use an adjustment screw inserted into the magnetic trip device through a bottom of the magnetic trip device and therefore through the yoke. The calibration via the bottom of the magnetic trip device is a less preferred access point, because additional calibration elements are needed and calibration is time-consuming and cost-intensive. In the context of the invention, calibration means a checking of the magnetic trip device against a reference, and a determining of and perhaps a minimising of the difference. That means that different measurements are compared, wherein one measurement is of known magnitude or correctness made or set with one device and another measurement is made in a similar way (as possible) with a second device.

SUMMARY

At least one embodiment of the present invention is directed to a thermal magnetic circuit breaker and especially a magnetic trip device of a thermal magnetic circuit breaker, which allows in an easy and cost-effective manner a calibration of itself during the production process in the production line and advantageously made by the end user of the thermal magnetic circuit breaker.

At least one embodiment of the present invention is directed to a magnetic trip device, a thermal magnetic circuit breaker and/or a method for adjusting a magnetic field area of a magnetic trip device. Further features and details of the invention are subject of the sub claims and/or emerge from the description and the figures. Features and details discussed with respect to the magnetic trip device can also be applied to the thermal magnetic circuit breaker or the method for adjusting a magnetic field area of a magnetic trip device, respectively, and vice versa.

The magnetic trip device of a thermal magnetic circuit breaker has at least an armature locator moveable arranged at a pin in order to adjust a magnetic field area, and an armature element fixed on a lower surface of said armature locator in order to interact with a yoke, which is arranged near a current conductive element for conducting electric energy. According to at least one embodiment of the present invention, the armature locator has an adjustment element arranged between a spring element and the yoke, wherein the spring element surrounding at least a part of the pin is arranged between the armature element and the yoke.

Furthermore, a method is disclosed for adjusting a magnetic field area of a magnetic trip device of a thermal magnetic circuit breaker. In at least one embodiment, the method includes at least:

turning a pin around its longitudinal axis, wherein an adjustment element engaged with a threaded portion of the pin and having a protrusion, which extends in a recess of a current conductive element, is raised or lowered along a longitudinal axis of the pin.

BRIEF DESCRIPTION OF THE DRAWINGS

Embodiments of an armature locator of a magnetic trip device and an embodiment of a magnetic trip device according to the invention will be explained in more detail with reference to the accompanying drawings. The drawings show schematically in.

Figure 1:
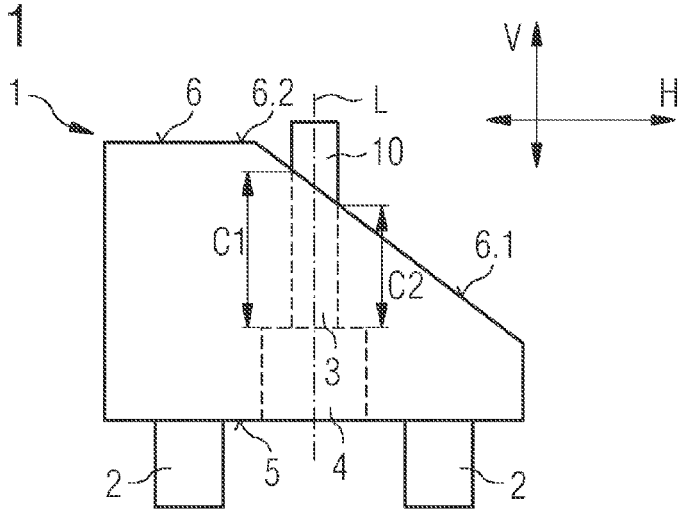
FIG. 1: a side view of a first embodiment of an armature locator of a magnetic trip device.

Elements having the same function and mode of action are provided in FIGS. 1 to 8 with the same reference signs.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The magnetic trip device of a thermal magnetic circuit breaker has at least an armature locator moveable arranged at a pin in order to adjust a magnetic field area, and an armature element fixed on a lower surface of said armature locator in order to interact with a yoke, which is arranged near a current conductive element for conducting electric energy. According to at least one embodiment of the present invention, the armature locator has an adjustment element arranged between a spring element and the yoke, wherein the spring element surrounding at least a part of the pin is arranged between the armature element and the yoke.

When the trip event like a short circuit occurs, a magnetic field is generated in the magnetic field area between the yoke and the armature element. Advantageously, each, the armature element and the yoke have a steel material. Therefore, a magnetic force of attraction between the armature and the yoke is created by a magnetic flux passing through these parts. By means of the magnetic force of the magnetic field, the armature and therefore the armature locator are pulled toward the yokes and away from the adjustment bar. The yoke is fixed on a base and especially in an area of a current conductive element, wherein the armature element moves towards the yoke, when the magnetic force overcomes the spring load of the spring element, which is for example a calibration spring. When for example the armature element reaches a distance of circa 2.7 mm away from the yoke, the armature locator attached to the armature element starts pushing a trip bar. When the armature element reaches for example a distance of circa 0.5 mm away from the yoke, the armature locator already pushes the trip bar to its final position, where the energy storage is released. Once the energy storage is released, it strikes the main mechanism and the thermal magnetic circuit breaker changes to a trip position breaking the current path of the current circuit.

Advantageously, the yoke has at least two layers, namely an inner layer and an outer layer or an inner yoke and an outer yoke, respectively. The total thickness of both layers of the yoke is required to obtain the magnetic force.

By way of the adjustment element, a calibration of the magnetic trip unit and especially of the magnetic field area of the magnetic trip unit from the top of the magnetic trip unit is provided in order to minimize complexity of fixturing needed in manufacturing.

Furthermore, it is conceivable that the adjustment element has at least one protrusion area, which extends downwards into a recess of a current conductive element, and a contacting area extending at least partially rectangular from the protrusion area. Advantageously, the perimeter of the cross-section of the protrusion or protrusion area, respectively, corresponds at least partially with the perimeter of the cross-section of the recess. That means that the width, the height and/or the length of the protrusion nearly correspond to the bright, the height and/or the length of the recess. The current conduction element is for example a current conduction line or an element, which contacts the current conduction line in order to absorb thermal energy and/or electrical energy. It is also thinkable that not the current conductive element has the recess, but the yoke, which contacts the current conductive element at least partially. Advantageously, the adjustment element has a non-conductive material or is coated with a non-conductive material. By means of the protrusion, which is like a nose or a hook a turning of the adjustment element is prevented. The contacting area is preferably designed like a plate and extends for example in a vertical direction nearly parallel to a surface of a current conductive element or to a lower surface of the armature element. The contacting area and the protrusion area of the adjustment element create a L-shaped adjustment element considered in a sectional view.

Advantageously, the contacting area of the adjustment element has a recess having an internal thread engaged with a threated portion of the pin. The threated portion of the pin is for example an external thread arranged at a lower area of the pin in order to engage at least with the internal thread of the adjustment element and/or with an internal thread of the current conductive element and/or an internal thread of the yoke. The adjustment element is moveable arranged at the pin by means of the internal thread, wherein due to a rotation of the pin about its longitudinal axis, the internal thread moves along the external thread in such a way that the adjustment element is moved up or down with respect to the yoke or the armature element and the armature locator. It is conceivable that the pin extends from the armature locator and especially from an adjustment bar for adjusting the armature locator in direction to the yoke and especially through a recess or a bore of the yoke. Thus, the adjustment element is for example a calibration plate arranged at an upper surface of the yoke or an upper surface of a current conductive element arranged at the yoke.

Therefore, during a turning of the pin around its longitudinal axis, the adjustment element arranged at the pin and especially engaged with an external thread of the pin by means of an internal thread of the adjustment element moves only up or down along the longitudinal axis of the pin and therefore in direction to the yoke or the current conductive element, respectively, or in direction to the armature element with the armature locator. Advantageously, the adjustment element is able to move along the longitudinal axis of the pin inside a range of for example circa 4 mm, respectively.

Additionally, it is possible that the contacting area of the adjustment element contacts a lower end of the spring element. By way of a movement of the adjustment element in an upward or downward direction, a spring load of the spring element is adjustable, for example. Therefore, the spring load of the spring element and especially of the calibration spring is adjustable by means of rotating the pin in an easy manner. That means, when the pin is rotated around its longitudinal axis, the adjustment element moves up or down, and as result, the spring element is compressed or decompressed, wherein a spring load of the spring element is changed. Advantageously, the adjustment of the spring load of the spring element is done at least in the production process of the magnetic trip device, wherein the adjustment element is fixed after a calibration process or test, respectively, in the production line.

It is possible that the armature locator oscillates on an axis of the pin, when the armature locator is moved along a longitudinal axis of the pin by means of the armature element at least during presence of high currents and therefore during the trip event is occurred or during an adjustment of the magnetic field area is done by an end user by means of an adjustment bar, for example. This oscillation can cause the armature locator to be in an angled or inclined position, which increases friction during movement thus affecting the response time during the trip event. To minimize this behavior, the length of a contact area of the armature locator around the pin needs to be sufficient. However, having a common adjustment of more than one armature locators and therefore of more than one magnetic trip devices requires using a common adjustment bar which limits available space and restricts size of this contact area.

Therefore, it is conceivable that the armature locator has a stabilizer element arranged at an upper surface of the armature locator in order to increase a contact area between the pin and the armature locator. Advantageously, the armature locator of the magnetic trip device has an armature locator design which is able to adjust a distance between the yoke and the armature element or the armature locator, respectively, in an easy manner for example by a costumer or an end user. The stabilizer element is additional arranged at an upper area or surface, respectively, of the armature locater, wherein the upper surface is a surface opposite the lower surface and therefore aligned in a direction away from the yoke and towards the adjustment bar.

With respect to at least one embodiment of the present invention, it is thinkable that the stabilizer element is a wall extending away from the upper surface of the armature locator in longitudinal direction of the pin, wherein the stabilizer element surrounds the pin at least partially in a perimeter direction of the pin. Therefore, the stabilizer element surrounds the pin extending outside the armature locator at least at one side of its perimeter. Advantageously, the stabilizer element surrounds the perimeter of the pin extending outside the armature locator for example of more than 25% and preferably nearly 50%. An entirely surrounding of the perimeter of the pin by means of the stabilizer element in the additional contact zone or area, respectively, created by the stabilizer element is not advantageously, because one side of the upper surface of the armature locator has to be contactable by a part of the adjustment bar. Therefore, advantageously the stabilizer element does not interfere with the movement of the adjustment bar.

The adjustment bar is used to adjust the distance mentioned above and especially an area of the magnetic field according to the customers concern. That means that the distance between the armature element and the yoke is reduced, when the costumer wishes an early interruption of the current circuit triggered by a short circuit of a low current. Therefore, the adjustment bar is moveable connected with the upper surface and especially with an area of the upper surface. Advantageously, the upper surface is at least partially inclined. Therefore, one area of the perimeter of the pin extending in the longitudinal direction of the pin is in contact with a wall of a through-hole of the armature locator more than another area of the perimeter of the pin which extends for example on the opposite of the perimeter of the pin. Based on the different sizes of the contact areas, the armature locator oscillates around the pin at least during a movement of the armature locator toward the yoke, like mentioned above. Therefore, a stabilizer element is arranged at least at one area of the upper surface of the armature locator in order to increase the contact area or contact zone, respectively, between the pin and the wall of the through-hole of the armature locator. By means of the adjustment bar the distance between the armature element and the yoke and therefore the magnetic field area is for example set at circa 10 mm for release at ten times the nominal current (10×ln) and is for example set at circa 3.2 mm for release at five times the nominal current (5×ln). Advantageously, the customer or the end user, respectively, is able to set the magnetic trip device between any of these two points.

Furthermore, it is required that the spring element arranged between the armature element or the armature locator, respectively, and the yoke or the adjustment element, respectively, requires a minimum space to reach a solid height. In the magnetic trip device, the working positions of this spring element and the required forces at those positions define the spring element dimensions. That means that the solid spring height resulting from the spring element design is a restriction that must be taken into account, because armature locator movement could be stopped when the spring reaches its solid state and is therefore completely compressed.

Thus, it is also possible that the armature locator has a recess or counterbore extending from the lower surface of the armature locator inwards the armature locator in direction to the upper surface of the armature locator in order to receive at least an upper end of the spring element surrounding at least a part of the pin between the armature element and the yoke in order to space the armature element and the yoke from each other at least partially. The lower surface extends at least partially parallel to a surface of the yoke.

Advantageously, the recess has a diameter of for example circa 8 mm and a depth of for example circa 7 mm. The recess allows using a spring element resulting with a larger solid height without limiting an adjustment element displacement or stopping the armature locator. The spring element is for example a calibration spring and especially a compression spring.

Furthermore, a thermal magnetic circuit breaker for protecting an electrical circuit from damage caused by overload or short circuit is claimed. The thermal magnetic circuit breaker has at least a thermal trip device, which has a bimetallic element responding to longer-term over-current conditions and a magnetic trip device according to one of the preceding claims and therefore according to a magnetic trip device mentioned above. Advantageously, the thermal magnetic circuit breaker, also named thermal magnetic trip unit (TMTU), has a translational magnetic system and especially a translational magnetic trip device with a common adjustment system like the adjustment bar for an instantaneous setting. Therefore, the adjustment is not done individually for each phase of the thermal magnetic circuit breaker.

Thus, it is conceivable that two or more magnetic trip devices are arranged at a common adjustment bar in order to adjust a magnetic field area of the magnetic drip devices at the same time. The adjustment bar has at least two or more protrusions extending from a lower surface of the adjustment bar in direction to the armature locator. Advantageously, the lower surface of these protrusions is inclined. The lower surface of these protrusions is able to contact the upper surface and especially an area of the upper surface of the armature locator, wherein the upper surface and especially the contact area of the upper surface of the armature locator is also inclined. Therefore, both the protrusions of the adjustment bar and the armature locator have inclined walls or surfaces, respectively, which contact each other.

Furthermore, a method is disclosed for adjusting a magnetic field area of a magnetic trip device of a thermal magnetic circuit breaker. In at least one embodiment, the method includes at least:

turning a pin around its longitudinal axis, wherein an adjustment element engaged with a threaded portion of the pin and having a protrusion, which extends in a recess of a current conductive element, is raised or lowered along a longitudinal axis of the pin.

The pin extends from the adjustment bar through the armature locator and through the armature element in direction to the yoke and the current conductive element arranged at the yoke. By means of turning the pin and raising or lowering the adjustment element, which is for example a calibration plate, a magnetic field area extending between the yoke and the armature element or the current conductive element and the armature element, respectively, is changeable in order to adjust the reaction moment of the armature element with regard to the magnetizing force. The adjustment of this distance between the yoke and the armature element is preferably done in the factory for manufacture the magnetic trip device and especially for manufacture the thermal magnetic circuit breaker at least during a calibration test. Advantageously, the adjustment element is fixed after obtain conforming results of this calibration test.

It is also conceivable that an adjustment bar is pushed horizontally along an upper surface of an armature locator, wherein an inclined protrusion of the adjustment bar, which is in contact with a surface of an inclined sliding area of the armature locator, slides along the surface of the sliding area in order to raise or lower the armature locator and the armature element arranged at a lower surface of the armature locator towards or from a yoke.

The adjustment of the armature element and therefore of the armature locator and especially the calibration of the magnetic field area extending between the yoke and the armature element or between the current conductive element and the armature element, respectively, is preferably done by the end user during a field of application. Therefore, the adjustment bar is moved manually by the end user. Advantageously, the end user rotates for example a knob that pushes the adjustment bar horizontally. Based on the movement of the adjustment bar, the armature locator is moved in a vertical direction and especially in direction to the yoke, which is preferably fixed inside the thermal magnetic circuit breaker. It is possible to move the adjustment bar within a range of circa 10 mm.

Thus, a spring element arranged between the armature element and the yoke is compressed or depressed due to the movement of the adjustment element along the pin or due to the movement of the armature locator along the pin. The spring element is for example a compression spring used to distance the armature element and therefore the armature locator arranged at the armature element from the yoke at least during no trip event occurs. The spring element has an upper end contacting the armature element and preferably the armature locator and a lower end contacting the adjustment element. Therefore, it is possible that the spring element extends through the armature element and especially a through-hole of the armature element, wherein an upper end of the spring element is arranged inside a recess like mentioned above of the armature locator. Advantageously, same type of spring elements are useable for different types of magnetic trip devices, wherein preferably the depth of the recess of the armature locator can be vary.

FIG. 1 shows a side view of a first embodiment of an armature locator 1 having a lower surface 5 and an upper surface 6 opposite to the lower surface 5. At least one protrusion 2 or also more than one protrusion 2 extends away from the lower surface 5 in order to pick up for example a not shown armature element. Therefore, it is possible that the armature has at least one recess and preferably more than one recess in which the protrusion 2 can be brought in. The protrusion 2 is a nose, a hook or such an element, for example. Furthermore, the armature locator 1 has a through-hole 3 extending through the material of the armature locator 1 from the upper surface 6 to the lower surface 5 and therefore in a vertical direction V. Especially in an area near the lower surface 5, the through-hole 3 has a bigger perimeter than in the remaining part. This expending area of the through-hole 3 is a recess 4 or a counterbore 4 in order to pick up at least a part of a not shown spring element. Advantageously, by means of the recess 4 a secured arrangement of the spring element is realized. That means that a slipping away of the spring element can be prevented.

Furthermore, a sufficiently dimensioned spring element can be used in the magnetic trip device without the risk of reaching a solid height or solid state, respectively, of a completely compressed spring element. That means that by means of the recess 4, the spring element has only a little prestressing after a calibration process by the operator in the production line or by the end user.

In addition, a pin 10 extending through the through-hole 3 and especially through the recess 4 is schematically indicated in FIG. 1. The pin 10 has a longitudinal axis L that is at least partially centric to a longitudinal axis of the through-hole 3 and to a longitudinal axis of the recess 4. The upper surface 6 has an inclined sliding area 6.1 and a straight area 6.2. The inclined sliding area 6.1 extends from the straight area 6.2 in a defined angle in direction to the lower surface 5. Therefore, between the pin 10 and especially the wall of the pin 10 and the wall of the through-hole 3, different contact zones C1, C2 are present. One, namely the first contact zone C1 is bigger and especially larger than the other, namely the second contact zone C2. Based on the different sizes of the contact zones C1 and C2, the armature locator 1 can be moved in an angled or inclined position, which increases friction during movement thus affecting the response time during a trip event.

Figure 2:
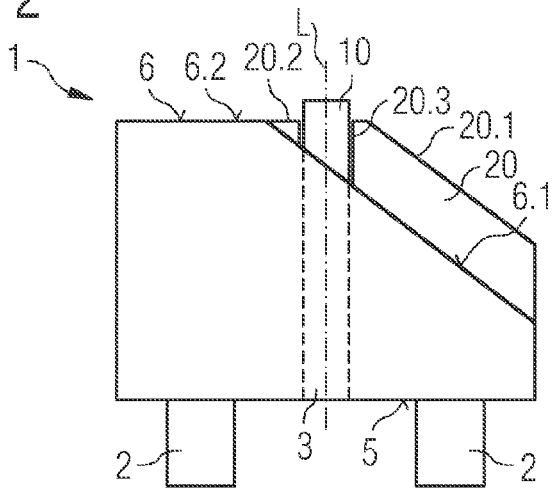
FIG. 2: a side view of a second embodiment of an armature locator of a magnetic trip device.

In order to overcome a large oscillation movement and a large inclination of armature locator 1 over the pin 10 axis L, it is possible to arrange a stabilizer element 20 at least at one side of the pin 10 on the armature locator like shown in FIG. 2. Advantageously, the stabilizer element 20 extends away from the upper surface 6 of the armature locator 1 and is arranged especially at the inclined sliding area 6.1 of the upper surface 6. The stabilizer element 20 is preferably a wall, which has a recess or a groove (not shown) for guiding the pin 10 in longitudinal direction L. The stabilizer element 20 encloses the pin 10 at least partially and increases at least the second contact area C2, shown for example in FIG. 1 and advantageously the first contact zone C1 too, also shown in FIG. 1. Advantageously, the stabilizer element 20 generates an additional contact zone or contact area, respectively.

The second embodiment of the armature locator 1 shown in FIG. 2 differs from the first embodiment of the armature locator 1 shown in FIG. 1 also by a missing recess or counterbore, respectively. Therefore, disadvantageously the spring design and especially the solid height of a spring element are limited.

Figure 3:
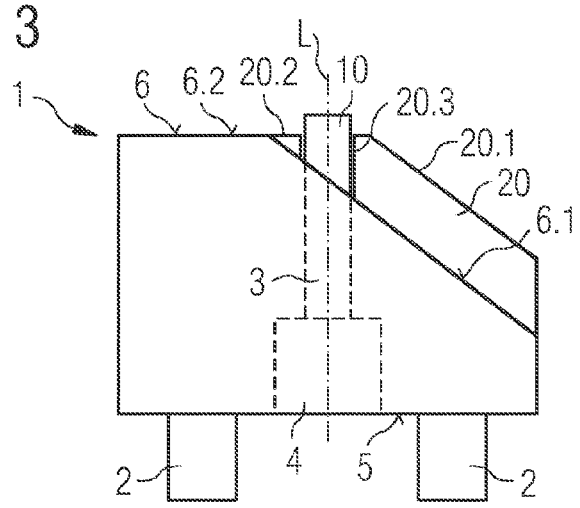
FIG. 3: a side view of a third embodiment of an armature locator of a magnetic trip device.

A third embodiment of an armature locator 1 having a recess 4 and a stabilizer element 20 is shown in FIG. 3. Therefore, the third embodiment of the armature locator 1 combines the advantages of the first embodiment of the armature locator shown in FIG. 1 with the advantages of the second embodiment of the armature locator 1 shown in FIG. 2. With respect to a cost-effective production of an armature locator 1, it is possible to reduce the mass of material taken to realize the stabilizer element 20. Therefore, it is conceivable to use a stabilizer element 20, which is only surrounding the hole, where the pin is passing through. A stabilizer element 20, which extends along the completely inclined sliding area 6.1 of the upper surface 6 is not required.

Figure 4:
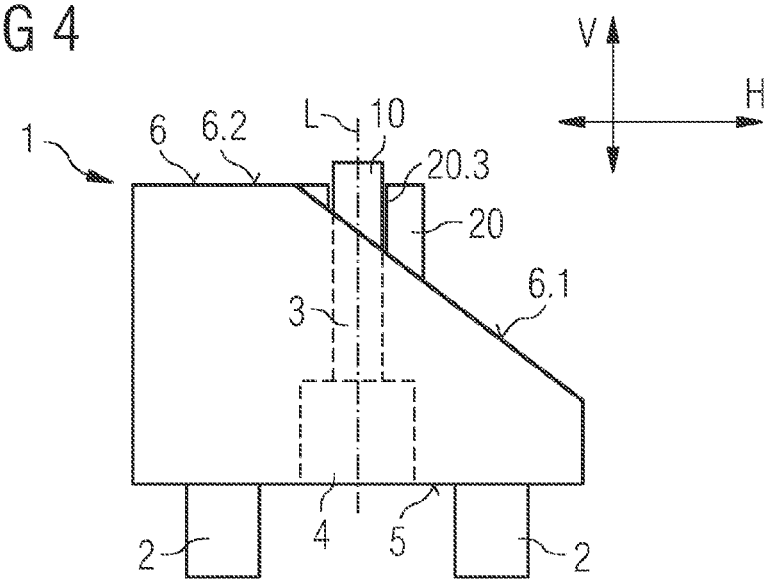
FIG. 4: a side view of a fourth embodiment of an armature locator of a magnetic trip device.

Therefore, a fourth embodiment of the armature locator 1 having a recess 4 and a stabilizer element 20 without excessive material is shown in FIG. 4. The stabilizer element 20 extends only partially on the inclined sliding area 6.1 of the upper surface 6 and increases the contact zones C1 and C2 in order to stabilize a movement of the armature locator in longitudinal direction L along the pin 10.

Figure 5:
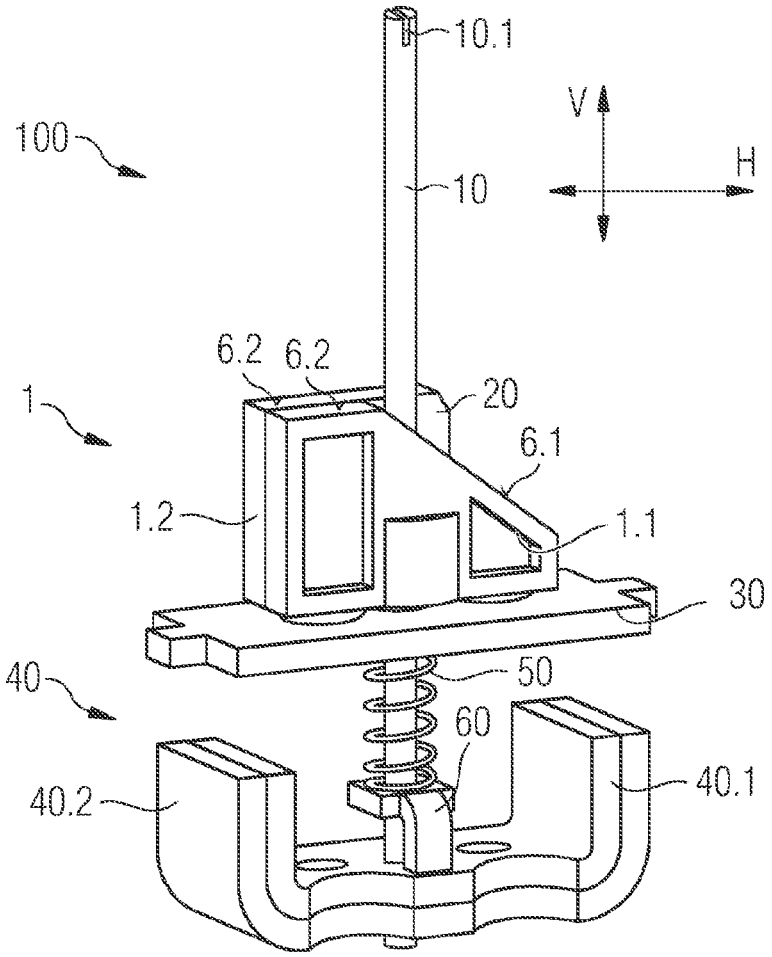
FIG. 5: a perspective view of an embodiment of a magnetic trip device having an armature locator according to FIG. 4, FIG. 6: a perspective view of an embodiment of a three-pole arrangement with a common adjustment bar.

In FIG. 5 an embodiment of a magnetic trip device 100 is shown, wherein the magnetic trip device 100 has an armature locator 1 shown in FIG. 4, for example. An armature element 30 is arranged at the lower surface 5 of the armature locator 1 and is fixed by the protrusions 2 of the armature locator 1. A spring element 50 is arranged between the armature element 30 and especially the armature locator 1 and a yoke 40. The yoke 40 has two layers, namely a first layer 40.1 and a second layer 40.2, wherein the first layer 40.1 is arranged on top of the second layer 40.2. The yoke 40 has an U-shape, wherein the legs of the U extend in direction to the armature element 30. The armature element 30 has a through-hole 30.1 for the spring element 50. The spring element 50 extends through the through-hole 30.1 in direction to the armature locator 1 and especially in direction to the lower surface 5 of the armature locator 1. Therefore, the spring element 50 has an upper end contacting the armature locator 1 and especially a wall of a recess 4 (cf. FIG. 5) of the armature locator 1, wherein a lower end of the spring element 50 contacts an adjustment element 60. The adjustment element 60 contacts at least partially the first layer 40.1 of the yoke 40 and has a protrusion area 60.1 which is preferably fixed at least in the first layer 40.1 or in the first 40.1 and the second layer 40.2 of the yoke 40 or in a not shown current conduction element.

The armature locator 1 shown in FIG. 5 has two layers 1.1 and 1.2, which extend in the longitudinal direction L and are fixed together in a contact area for contacting the pin 10. Both layers 1.1, 1.2 have an upper surface 6 having an inclined sliding area 6.1 and a straight area 6.2. A stabilizer element 20 is arranged only at one layer and according to FIG. 5 at the second layer 1.2 of the armature locator 1. Therefore, the sliding area 6.1 of the first layer 1.1 of the armature locator 1 is usable for sliding a protrusion or nose of an adjustment bar (shown in FIG. 6) over it. The stabilizer element 20 has a recess 20.3 or groove 20.3, respectively, in order to guide the pin 10 in a longitudinal direction L. Advantageously, the pin 10 is surrounded by means of the stabilizer element 20 at least partially. The pin 10 has a slot 10.1 at its upper end. By means of this slot 10.1, the pin is rotatable around its longitudinal axis L. Therefore, an intervention element like a knob or such an element is able to intervene into this slot 10.1 in order to interact with the pin 10.

Figure 6:
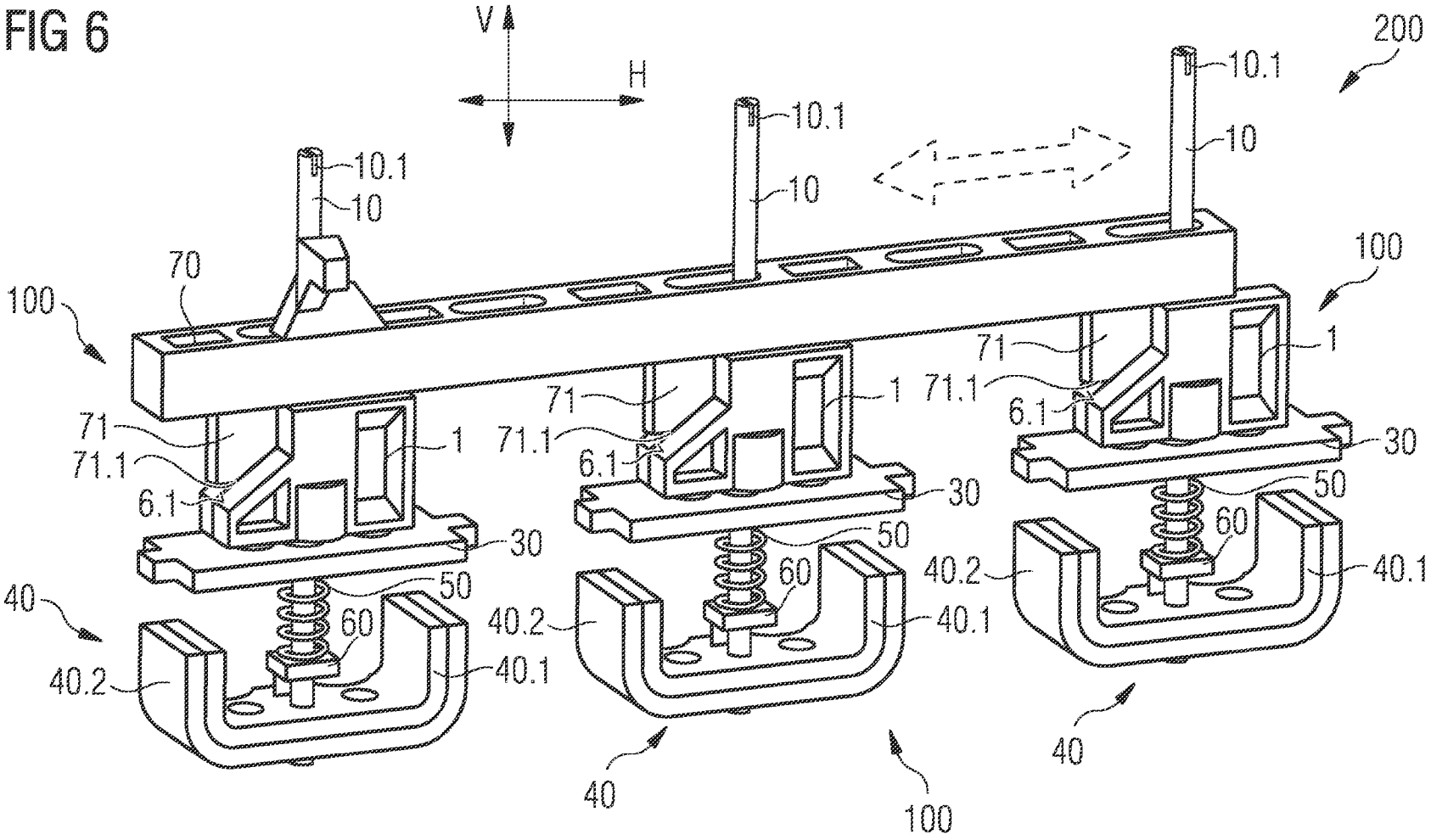

FIG. 6 shows a three-pole arrangement 200 of the magnetic trip device 100 shown in FIG. 5. Therefore, the explanations about the magnetic trip device 100 shown in FIG. 5 are used as basement for the explanations of the arrangement of FIG. 6. The three-pole arrangement 200 has three magnetic trip devices 100 arranged at a common adjustment bar 70. The adjustment bar 70 is usable to adjust the distance between the armature element 30 and the yoke 40 of each magnetic trip device 100 in a same time. The adjustment bar 70 is moveable in a horizontal direction H, shown with the arrow in FIG. 6. The protrusion 71 of the adjustment bar 70 contacts the armature locator 1 and especially the inclined sliding area 6.1 of the upper surface 6 of the armature locator 1. Therefore, the protrusion 71 also has an inclined area 71.1, which contacts the inclined area 6.1 of the armature locator 1. Advantageously, the inclined area 71.1 or wall 71.1, respectively, of the protrusion 71 has a gradient with a defined angle, wherein the inclined area 6.1 or wall 6.1, respectively, of the armature locator 1 has a descent having a comparable angle.

Based on the movement of the adjustment bar 70 the inclined area 71.1 of the protrusion 71 of the adjustment bar 70 is moved along the inclined area 6.1 of the armature locator 1, wherein the armature locator 1 is caused to move downwards in direction to the yoke 40 or upwards in direction to the adjustment bar 70. Therefore, a movement of the adjustment bar 70 in a horizontal direction H results in a movement of the armature locator 1 in a longitudinal direction L and especially in a vertical direction V.

Figure 7:
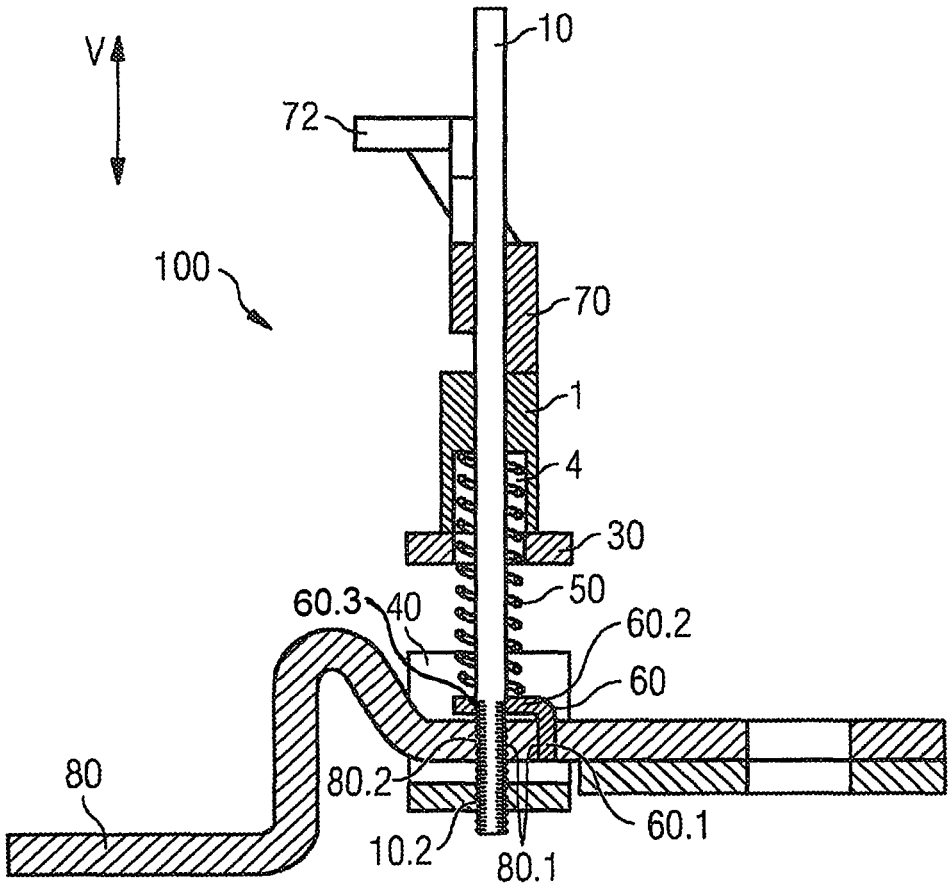
FIG. 7: a lateral sectioning of an embodiment of a magnetic trip device arranged at a current conductive element.

FIG. 7 shows a lateral sectioning of an embodiment of a magnetic trip device 100 contacting a current conductive element 80 extending essentially at least partially in a horizontal direction H along a lower plane of the magnetic trip device 100. The current conductive element 80 contacts the yoke 40 and especially its upper layer 40.1 or first layer 40.1, respectively. Therefore, the current conductive element 80 extends through the yoke 40 and essentially between the legs of the yoke 40 along the yoke 40. The current conductive element 80 for conducting an electrical current along an electrical path has a recess 80.1, which is formed like a hole or a bore for example. A protrusion area 60.1 like a nose or a hook of the adjustment element 60 extends into this recess 80.1. The adjustment element 60 which is preferably designed like a calibration plate has a L-shape with respect to its cross-section, wherein one leg of the L is the protrusion area 60.1 and the other leg of the L is a contacting area 60.2 extending essentially at least partially parallel to a surface of the current conductive element 80 in the area of the yoke 40. The contacting area 60.2 is used to clamp the spring element 50 between the adjustment element 60 and the armature locator 1. It is conceivable that the lower end of the spring element 50 contacting the adjustment element 60 is fixed with the adjustment element 60, wherein for example an end of the winding of the spring element extends into the contacting area 60.2 and especially into a recess or such a thing of the contacting area 60.2 of the adjustment element 60. Advantageously, the spring element 50 is removable arranged at or fixed with the adjustment element 60.

The pin 10 extends through the adjustment bar 70, through the armature locator 1 and through the armature 30 in direction to the yoke 40 and preferably through the yoke 40 and therefore also through the current conductive element 80. The lower part of the pin 10 has a threaded portion 10.2 and especially an external thread 10.2 which is moveable engaged with an internal thread 60.3 of the adjustment element 60 and also with an internal thread 80.2 of the current conductive element 80 and especially of a second clearance bore 80.3 or hole 80.3 of the current conductive element 80. It is also conceivable that the current conductive element 80 has only a clearance hole 80.3 without any thread and therefore without the internal thread 80.2 mentioned above.

The spring element 50 extends between the adjustment element 60 and the armature locator 1, through the armature element 30 and especially through a bore 30.1 or a through-hole 30.1 of the armature element 30. The spring element 50 surrounds the pin 10 and especially the perimeter of the pin 10 along a longitudinal axis L of the pin 10. Advantageously, the upper end or an upper area, respectively, of the spring element 50 is arranged inside a recess 4 or a counterbore 4, respectively, of the armature locator 1. The spring element 50 has a defined spring load and spaces the armature 30 from the yoke 40, when no trip event like a short circuit occurs.

The adjustment bar 70 has a transfer element 72 extending in a horizontal direction away from the adjustment bar 70. By means of this transfer element 72, a movement of the adjustment bar 70 initiated by an end user or customer in a horizontal direction H in order to move the armature locator 1 in a vertical direction V is enabled. Basing on the movement of the armature element 30 in direction to the yoke 40 during a trip event, the armature locator 1 is moved in vertical direction V along the pin 10, wherein basing on this movement a trip bar is pushed to its final position, where the energy storage (also not shown in FIG. 7) is released.

Figure 8:
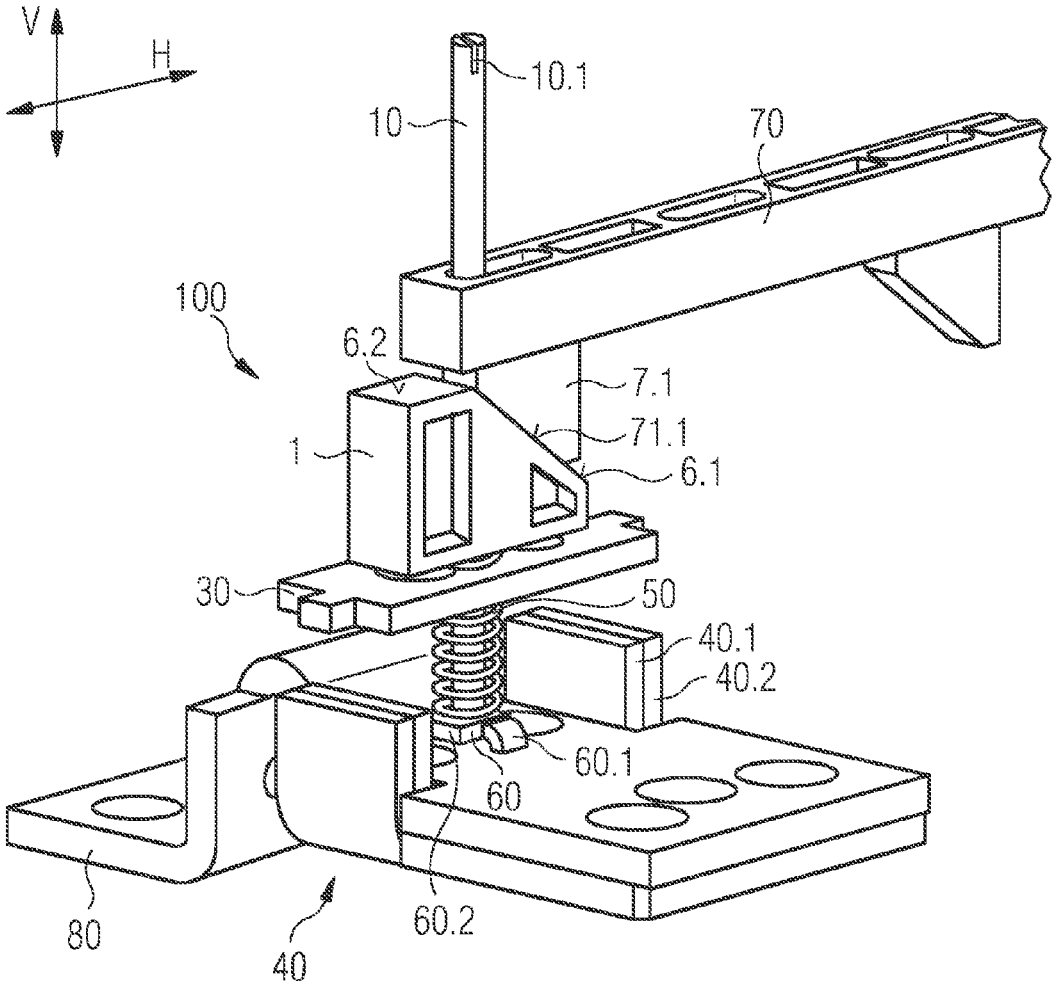
FIG. 8: a perspective view of the magnetic trip device shown in FIG. 7.

In FIG. 8 a perspective view of the magnetic trip device 100 pictured in FIG. 7 is shown, wherein especially the arrangement of the adjustment bar 70 and the armature locator 1 is clarified. When the adjustment bar 10 moves in a horizontal direction H, for example in direction to the armature locator 1 (leftwards), the armature locator 1 moves downwards in direction to the yoke 40. Based on the movement mentioned above the distance between the armature element 30 and the yoke 40 is reduced just like the magnetic field area extending at least partially between the yoke 40 and the armature element 30. The transformation of the horizontal movement of the adjustment bar 70 into a vertical movement of the armature locator 1 is done by means of both the inclined area or inclined surface, respectively, of the protrusion 71 of the adjustment bar 70 and the inclined area or surface, respectively, of the armature locator 1. Both inclined areas 71.1 and 6.1 contacts each other and are moveable arranged to each other in such a way that the inclined areas 71.1 and 6.1 slide against each other. Therefore, during a horizontal movement of the adjustment bar 70 in direction away from the armature locator 1 (rightwards), the armature locator 1 is moved in vertical direction away from the yoke 40 (upwards), due to the spring load of the spring element 50. That means that the spring element 50 pushes back the armature locator 1. The adjustment bar 70 is only shown in sections in FIG. 8 and has preferably more than one protrusion 71 and especially two or three protrusions 71 in order to contact two or three single magnetic trip devices 100, for example as three pole arrangement 200 shown in FIG. 6.

REFERENCE SIGNS

1 armature locator
1.1 first wall of the armature locator
1.2 second wall of the armature locator
2 protrusion of the armature locator
3 through-hole of the armature locator
4 recess of the armature locator
5 lower surface of the armature locator
6 upper surface of the armature locator
6.1 inclined sliding area/surface of the upper surface
6.2 straight area/surface of the upper surface
10 pin
10.1 slot
10.2 thread/external thread
20 stabilizer element
20.1 inclined area of the stabilizer element
20.2 straight area of the stabilizer element
20.3 recess/groove of the stabilizer element
30 armature element
30.1 through-hole of the armature
40 yoke
40.1 first layer of the yoke
40.2 second layer of the yoke
50 spring element
60 adjustment element
60.1 protrusion area of the adjustment element
60.2 contacting area of the adjustment element
60.3 thread/internal thread of the adjustment element
70 adjustment bar
71 protrusion/nose of the adjustment bar
71.1 inclined area of the protrusion
71 transfer element of the adjustment bar
80 current conductive element

80.1 recess of the current conductive element
80.2 thread/internal thread of the current conductive Element
100 magnetic trip device
200 three pole arrangement
C1 first contact zone
C2 second contact zone
H horizontal direction
L longitudinal axis/direction
V vertical direction

What is claimed is:

1. Magnetic trip device of a thermal magnetic circuit breaker, the magnetic trip device comprising:

an armature locator, moveably arranged around a pin to adjust a magnetic field area;

an armature element, fixed on a lower surface of said armature locator, to interact with a yoke, arranged near a current conductive element, for conducting electric energy; and an adjustment element, arranged between a spring element and the yoke, wherein a portion of the spring element surrounding at least a part of the pin is arranged between the armature element and the yoke, wherein the adjustment element includes at least one protrusion area, extending downwards into a recess of the current conductive element, and a contacting area, extending at least partially rectangular from the protrusion area.

2. Magnetic trip device of claim 1, wherein the contacting area of the adjustment element includes a recess having an internal thread engaged with a threaded portion of the pin.

3. Magnetic trip device of claim 2, wherein the contacting area of the adjustment element contacts a lower end of the spring element.

4. Magnetic trip device of claim 1, wherein the armature locator includes a stabilizer element arranged at an upper surface of the armature locator to increase a contact area between the pin and the armature locator.

5. Magnetic trip device of claim 1, wherein the armature locator includes a recess in the armature locator that receives at least an upper end of a spring element, wherein the spring element surrounds at least a part of the pin between the armature element and the yoke.

6. Thermal magnetic circuit breaker for protecting an electrical circuit from damage caused by overload or short circuit, comprising:

a thermal trip device, including a bimetallic element responding to longer-term over-current conditions; and the magnetic trip device of claim 1.

7. Thermal magnetic circuit breaker of claim 6, wherein the magnetic trip device includes two or more magnetic trip devices, arranged at a common adjustment bar, to adjust a magnetic field area of the magnetic drip devices at the same time.

8. Method for adjusting a magnetic field area of a magnetic trip device of a thermal magnetic circuit breaker, comprising:

providing a pin that passes through an armature of the magnetic trip device, turning a pin around its longitudinal axis, threading the pin into an adjustment element engaged with a threaded portion of the pin and a current conductive element, the adjustment element being raised or lowered along the longitudinal axis of the pin.

9. Method of claim 8, wherein an adjustment bar is pushed horizontally along an upper surface of an armature locator, wherein an inclined protrusion of the adjustment bar, in contact with a surface of an inclined sliding area of the armature locator, slides along the surface of the inclined sliding area to raise or lower the armature locator and the armature element arranged at a lower surface of the armature locator towards or from a yoke arranged near a current conductive element.

* * * * *